US005254442A

United States Patent [19]

Kuse et al.

[11] Patent Number: 5,254,442

[45] Date of Patent: Oct. 19, 1993

[54] METHOD OF PROCESSING SILVER HALIDE COLOR PHOTOGRAPHIC MATERIALS AND A PROCESSING APPARATUS THEREFOR

[75] Inventors: Satoru Kuse, Hino; Sigeharu Koboshi, Sagamihara; Masayuki Kurematsu, Hino, all of Japan

[73] Assignee: Konica Corporation, Tokyo, Japan

[21] Appl. No.: 637,949

[22] Filed: Jan. 8, 1991

Related U.S. Application Data

[63] Continuation of Ser. No. 381,841, Jul. 19, 1989, abandoned.

[30] Foreign Application Priority Data

Jul. 21, 1988 [JP] Japan ..... 63-182278
Jul. 22, 1988 [JP] Japan ..... 63-183827

[51] Int. Cl.[5] ..... G03C 7/00

[52] U.S. Cl. ..... 430/393; 430/403; 430/428; 430/430; 430/963; 430/319; 430/320; 430/321; 430/322; 430/331

[58] Field of Search ..... 430/393, 403, 428, 430, 430/963, 319, 320, 321, 322, 331

[56] References Cited

U.S. PATENT DOCUMENTS

| | | | |
|---|---|---|---|
| 3,620,725 | 11/1971 | Kosta | 430/963 |
| 4,845,019 | 7/1989 | Vaughan | 430/428 |
| 4,925,778 | 5/1990 | Wernicke | 430/963 |
| 4,977,422 | 12/1990 | Vaughan | 354/317 |
| 5,114,836 | 5/1992 | Sato et al. | 430/963 |

FOREIGN PATENT DOCUMENTS

| | | | |
|---|---|---|---|
| 898040 | 4/1972 | Canada | 430/963 |
| WO 87/04534 | 7/1987 | PCT Int'l Appl. | 430/963 |

*Primary Examiner*—Charles L. Bowers, Jr.
*Assistant Examiner*—Thomas R. Neville
*Attorney, Agent, or Firm*—Finnegan, Henderson, Farabow, Garrett and Dunner

[57] ABSTRACT

A method of processing silver halide color photographic material is disclosed. The process comprises a step of color development, a step of processing with a processor having a bleaching power and a step of stabilization, wherein an air-time ratio at a step of color development, or a step of processing with a processor having a bleaching power is 15 to 65%.

11 Claims, 3 Drawing Sheets

METHOD OF PROCESSING SILVER HALIDE COLOR PHOTOGRAPHIC MATERIALS AND A PROCESSING APPARATUS THEREFOR

This application is a continuation of application Ser. No. 07/381,841, filed Jul. 19, 1989, now abandoned.

FIELD OF THE INVENTION

The present invention relates to a method of processing silver halide color photographic materials and a processing apparatus to be used therefor.

BACKGROUND OF THE INVENTION

In general, in order to obtain a color photographic image by processing an imagewise exposed silver halide photographic material, the silver halide photographic material is processed in a color developing process, and the metallic silver formed in the process is desilvered and then processed in a subsequent washing process, stabilizing process or washing-substitute stabilizing process. In recent years, however, demand has risen for developing technology for super-rapidly processing photographic light-sensitive materials.

The conventional technology for rapidly processing those photographic light-sensitive materials may be broadly classified into three rapid processing techniques accomplished by:

(1) improving photographic materials,
(2) physical means at the time of processing, and
(3) improving the compositions of the processing solutions to be used in processing photographic materials.

As for the above (2), there are techniques for stirring processing solutions, such as those techniques for stirring the processing solutions inside an automatic processor as disclosed in Japanese Patent Publication Open to Public Inspection (hereinafter referred to as Japanese Patent O.P.I. Publication) No. 180369/1987.

And, regarding the above (3), 1) techniques which use a development accelerator, 2) techniques for concentrating a color developing agent, and 3) techniques for lowering the concentration of halide ions, particularly bromide ion, and the like, are known.

Of the above-mentioned various rapid processing techniques, an example of the one relating to the above (1) include those techniques which use high light-sensitive silver chloride-content light-sensitive silver halide photographic materials as described in. e.g., Japanese Patent O.P.I. Publication Nos. 95345/1983, 19140/1985, 95736/1983, and the like. These techniques are excellent in achieving highly rapid processing. Such techniques have recently been made practical reality as seen in, e.g., 'Ektacolor 2001 paper' manufactured by Eastman Kodak Company, and 'KONICA Color QA Paper' by KONICA Corporation.

Any of these rapid processing techniques, however, tend to produce a fog in the unexposed area of photographic materials since they utilize physically or chemically highly active conditions. This is particularly a problem with light-sensitive photographic material of a high silver chloride content (especially, one having a silver halide containing not less than 80 mole % silver chloride) which tends to produce a fog all the more because of its rapid processability. Where the photographic material is a color photographic paper, the fog that appears in the unexposed area becomes such a serious problem as to lose the value of the material as a commodity.

SUMMARY OF THE INVENTION

It is an object of the present invention to provide a method of processing a photographic light-sensitive material which enables super-rapid processing, and also to provide an automatic processor to be used therefor.

It is another object of the present invention to provide a method for processing a photographic light-sensitive material which, even in the super-rapid processing, is capable of processing a photographic light-sensitive material stably while hardly producing a fog, and also to provide an automatic processor to be used therefor.

It is a further object of the present invention to provide a method for processing a photographic light-sensitive material which, even when super-rapidly processing a high silver chloride-content photographic light-sensitive material, restrains the occurrence of fogging and is capable of always giving a constant color image, and also to provide an automatic processor to be used therefor.

It is still another object of the present invention to provide a method for processing a photographic light-sensitive material and an automatic processor to be used therefor which are so improved as to hardly cause the photographic material to be dye-stained by the underliquid transport roller of the processor.

It is a still further object of the present invention to provide a method for processing a photographic light-sensitive material, in which the photographic light-sensitive material is improved on its desilverizing characteristic, and also to provide an automatic processor to be used therefor.

Still other objects of the present invention will become apparent in the following description of this invention.

A silver halide photographic material which has been imagewise exposed for the formation of an image is processed in a series of steps including the color developing process and the process for bleaching and fixing of silver. According to the present invention, in these processes, the photographic material is processed under the condition of an air-time ratio of from 15 to 65%. The air-time ratio is applied to each of the color developing process and the bleaching or bleach-fix process. It is desirable that no extra processing step be placed between the color developing process and the bleaching or bleach-fix process. The bleaching process is usually followed by a fixing process. The photographic material which has been processed in the fixing process is then processed in a stabilizing process.

In the present invention, the term 'air-time ratio' in the processing steps implies what percent the period of time while a photographic material is exposed to air accounts for of the period of time from the beginning of the immersion of the photographic material in one processing solution until its immersion in the subsequent processing solution in the series of processing steps. For example, the air-time ratio in the color developing process implies the proportion of the period of time (air-time) B from the moment when the leading end of a photographic material gets out of the color developer solution until the moment when the leading end is put in the bleaching solution or bleach-fix solution in the subsequent process to the processing period of time A in the color developing process from the moment when the leading end of the photographic material touches the color developer solution until the moment when the leading end touches the bleaching solution or bleach-fix solution in the subsequent process; i.e., $B/A \times 100$ (%).

In the present invention, the above air-time ratio is from 15 to 65%, preferably from 20 to 50% and more preferably from 25 to 40%.

If the air-time ratio in the color developing process is raised, it is inferred that the oxidation product of the color developing agent or the organic restraining agent contained in the color developer solution or in the photographic material tends to be selectively adsorbed to the sensitivity speck of the unexposed area's silver halide, thereby restraining the occurrence of fogging. In the bleaching solution or bleach-fix solution, if the air-time ratio is raised, it is inferred that the ferrous ethylenediaminetetraacetate as a bleaching agent, which is attached onto the photographic material, is easily transformed into ferric one, thus tending to accelerate the bleaching reaction, and consequently, this also serves to restrain the occurrence of fogging.

Further, it is found that the increase in the air-time ratio in the color developing process has the effect of restraining the automatic processor's under-liquid transport roller in the developer liquid from being dyed, which tends to occur during highly active processing.

The phenomenon that the under-liquid transport roller is dyed is due to the fact that, in a super-rapid processing, the emulsion layer in the color developer liquid quickly swells and forms a dye, and in this instance, when physical pressure by the roller is applied to the surface of the emulsion layer, the dye formed inside the emulsion layer is dissolved out into the liquid and then attaches onto the roller. The dye is then transferred from the roller onto another photographic material, thus causing an undesirable stain problem. The swelling of the emulsion layer can be controlled by raising the air-time ratio, whereby improvement on the roller-dyeing problem and dye stain problem can be carried out.

Further, it is also found that the increase in the air-time ratio in the bleaching or bleach-fix process accelerates the reclamation of the ferrous ethylenediaminetetraacetate as a bleaching agent into ferric one to thereby reduce the residual silver.

The present invention has been made on the basis of the above-mentioned knowledge, and any of the aforementioned effects are contrary to conventionally established common sense in the photographic industry that the shorter the air-time in an automatic processor, the better.

DETAILED DESCRIPTION OF THE INVENTION

In the present invention, in order to bring a photographic material into contact with a processing liquid, besides immersing the photographic material, various other methods may be used which include; for example, a method of spraying a processing liquid over the photographic material, a method of contacting a processing liquid-impregnated carrier with the photographic material, and a method of coating a viscous processing liquid on the photographic material. The processing steps comprise at least a color developing process, a bleach-fix process or bleaching and fixing processes, and the like.

The present invention will now be explained with reference to the processor shown in the accompanying drawings.

Figure 1:
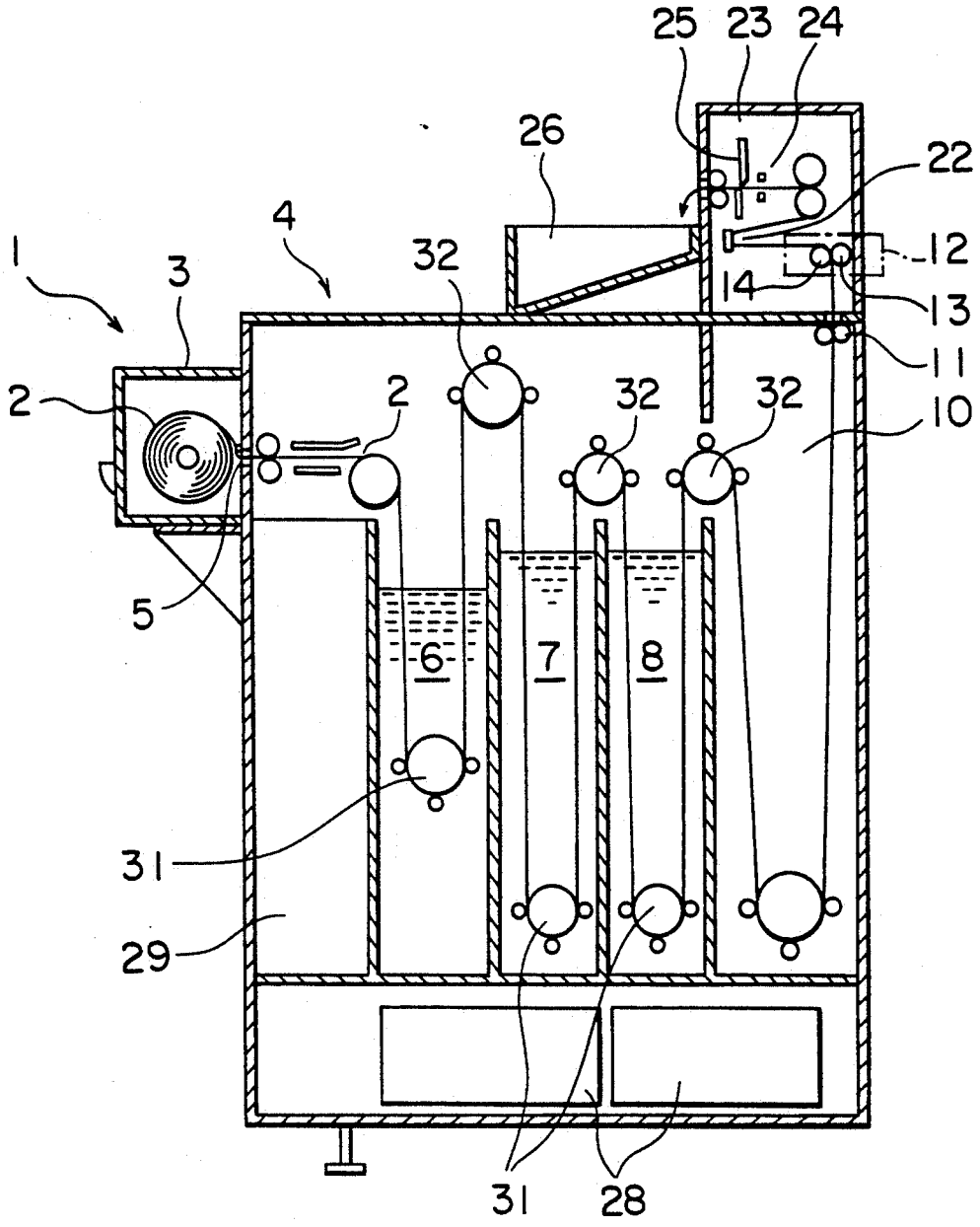
FIG. 1 is a drawing showing a model example of the processor applicable to this invention.

FIG. 1 is a schematic drawing of a processor. An exposed photographic material 2 is transported through a developer liquid 6, a bleach-fix liquid 7 and a stabilizer liquid 8 by transport rollers 31 and 32. Development of photographic material 2 takes place during the period of from the moment when photographic material 2 gets into developer liquid 6 until the material reaches the surface of bleach-fix liquid 7.

The ratio of the total air-time period to the overall period of time of the whole processes may be discretionally set by selecting the transport speed of the photographic material, the surface level of the processing liquids, and the locations of under-liquid rolls 31 and in-air rolls 32. In FIG. 1, the air-time ratio for the developer liquid is set to be high.

Figure 2:
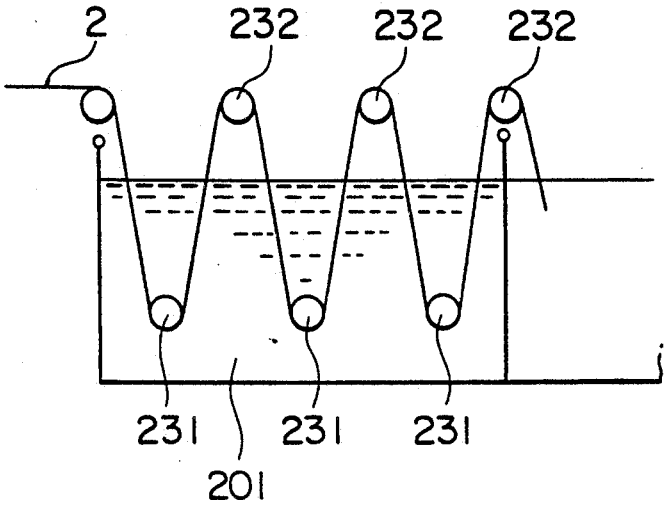
FIGS. 2 through 5 are fragmentary sectional views of the processor for showing air-time conditions.

In setting an air-time ratio, the under-liquid time and in-air time may be alternately repeated during the processing of a photographic material in the same processing liquid. FIG. 2 is an example of this, shown in the model form.

A desired air-time ratio may be obtained by appropriately setting by the surface level of processing liquid 201 (e.g., bleacher solution) and the level of one or two or more in-air rolls 232, or one or two or more under-liquid rollers 231.

Figure 3:
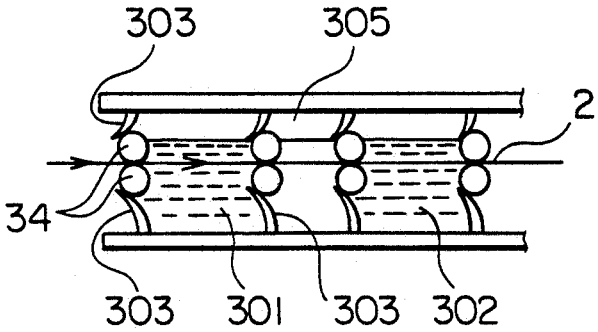

The respective processing methods may be appropriately selected. FIG. 3 shows that photographic material 2 is transported through a processing liquid that is held by blades 303 and rolls 34. In the figure, the numbered 305 is air spacing or part exposed to air. The liquids 301 and 302 may be either the same or different—for example, both of them may be either the same developer liquid or different liquids such as a bleacher solution and a fixing solution. Alternatively, even though they are liquids for the same processing they may have different components.

Figure 4:
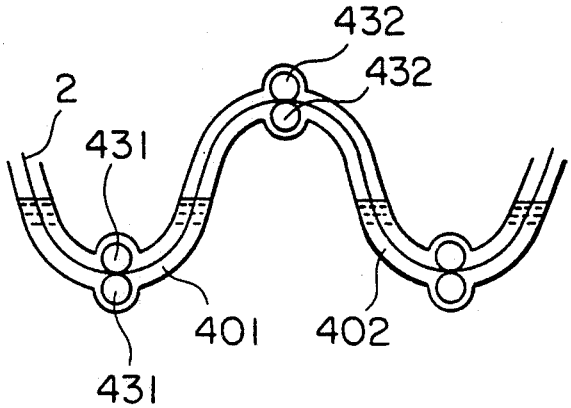

FIG. 4 shows that photographic material 2 is processed while being transported through a processing liquid held by two wavy plates. A necessary air-time ratio can be obtained by setting the surface level of the processing liquid. Regarding the liquid, the same as in the above 301 and 302 may be said of processing liquids 401 and 402.

Figure 5:
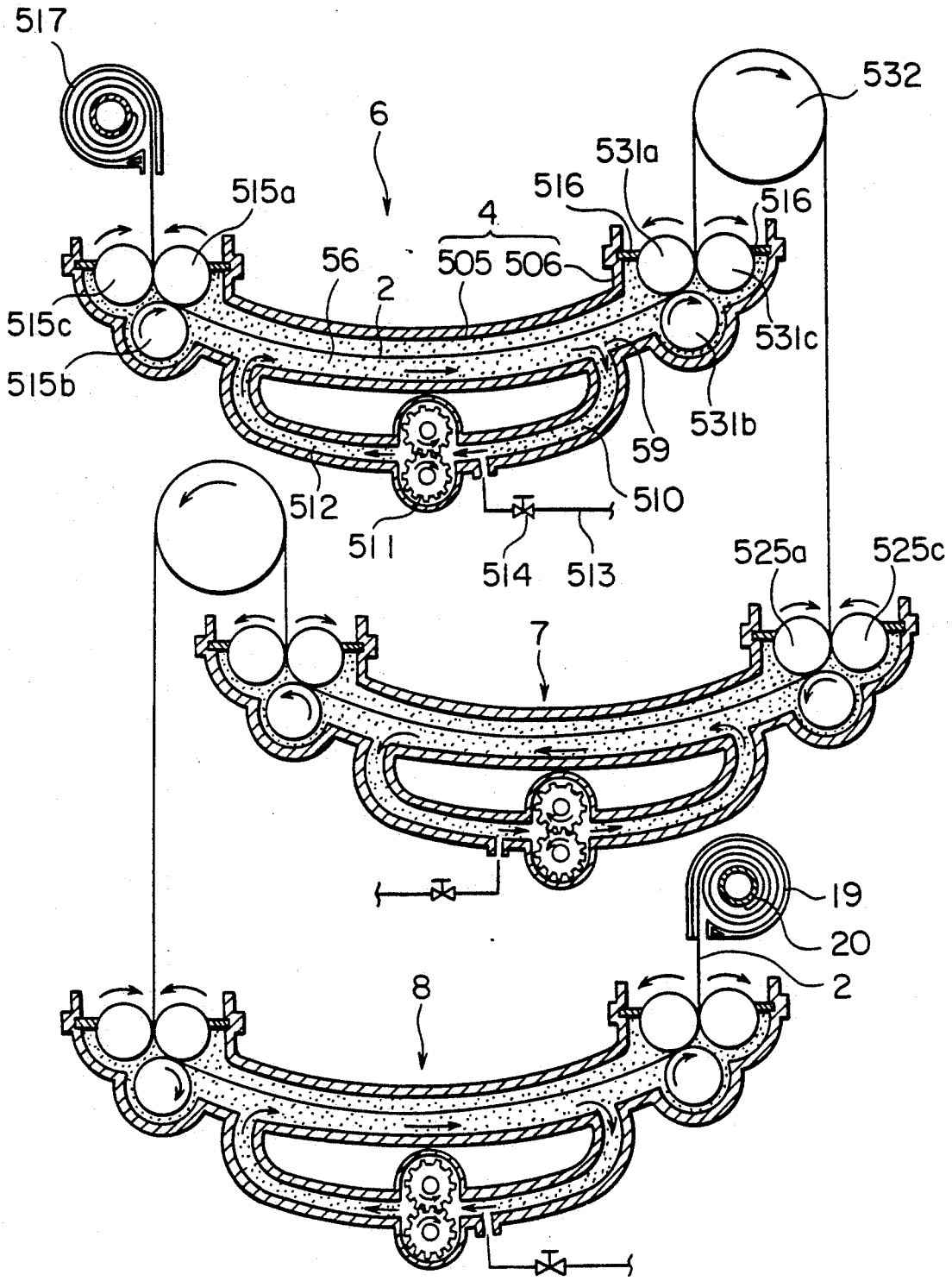

FIG. 5 is a drawing also showing an example, in which an imagewise exposed photographic material 2 that comes out of a holder 517 is conducted by rollers **515*a* and 515*c* into developer liquid 56, and then through an in-air roller 532 to be conducted by the entrance rollers 525*a* and 525*c* of the subsequent bleach-fix unit 7 into bleach-fix liquid. A specific air-time ratio can be obtained by setting, e.g., the level of in-air roll 532**.

The color developer solution applicable to the present invention will now be explained.

The color developer solution desirably contain a compound having Formula [I] (hereinafter may sometimes be called the 'preservative of this invention') for the purpose of improving its rapid processing and antifogging capabilities.

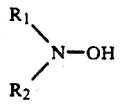

[I]

wherein $R_1$ and $R_2$ each represents a hydrogen atom or an alkyl group, provided that the $R_1$ and $R_2$ are not allowed to be hydrogen atoms at the same time.

The alkyl groups represented by the $R_1$ and $R_2$ may be either the same as or different from each other, and each is preferably an alkyl group having from 1 to 3 carbon atoms. The alkyl group represented by $R_1$ or $R_2$ includes those having a substituent such as, for example, hydroxy, sulfo, carboxy, lower alkoxy, or the like group. The $R_1$ and $R_2$ are allowed to combine with each other to form a ring; e.g., a heterocyclic ring such as piperidine or morpholine.

Particular examples of those hydroxylamine-type compounds represented by Formula [I] are disclosed in U.S. Pat. Nos. 3,287,125, 3,293,034 and 3,287,124, but the preferred examples of such compounds are as follows:

Exemplified Compounds:

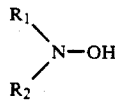

| Exemplified compound No. | $R_1$ | $R_2$ |
|---|---|---|
| A-1 | $-C_2H_5$ | $-C_2H_5$ |
| A-2 | $-CH_3$ | $-CH_3$ |
| A-3 | $-C_3H_7(n)$ | $-C_3H_7(n)$ |
| A-4 | $-C_3H_7(i)$ | $-C_3H_7(i)$ |
| A-5 | $-CH_3$ | $-C_2H_5$ |
| A-6 | $-C_2H_5$ | $-C_3H_7(i)$ |
| A-7 | $-CH_3$ | $-C_3H_7(i)$ |
| A-8 | $-H$ | $-C_2H_5$ |
| A-9 | $-H$ | $-C_3H_7(n)$ |
| A-10 | $-H$ | $-CH_3$ |
| A-11 | $-H$ | $-C_3H_7(i)$ |
| A-12 | $-C_2H_5$ | $-C_2H_4OCH_3$ |
| A-13 | $-C_2H_4OH$ | $-C_2H_4OH$ |
| A-14 | $-C_2H_4SO_3H$ | $-C_2H_5$ |
| A-15 | $-C_2H_4COOH$ | $-C_2H_4COOH$ |
| A-16 | 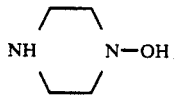 | |
| A-17 | 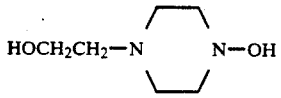 | |
| A-18 | 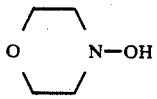 | |
| A-19 | 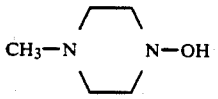 | |
| A-20 | $-CH_3$ | $-C_2H_4OCH_3$ |
| A-21 | $-C_2H_4OCH_3$ | $-C_2H_4OCH_3$ |
| A-22 | $-C_2H_4OC_2H_5$ | $-C_2H_4OC_2H_5$ |
| A-23 | $-C_3H_6OCH_3$ | $-C_3H_6OCH_3$ |

-continued

Exemplified Compounds:

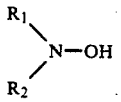

| Exemplified compound No. | $R_1$ | $R_2$ |
|---|---|---|
| A-24 | $-C_2H_5$ | $-C_2H_4OC_2H_5$ |
| A-25 | $-C_3H_7$ | $-C_2H_4OCH_3$ |
| A-26 | $-CH_3$ | $-C_2H_4OC_2H_5$ |
| A-27 | $-CH_3$ | $-CH_2OCH_3$ |
| A-28 | $-C_2H_5$ | $-CH_2OC_2H_5$ |
| A-29 | $-CH_2OCH_3$ | $-CH_2OCH_3$ |
| A-30 | $-C_2H_5$ | $-C_2H_4OC_3H_7$ |
| A-31 | $-C_3H_6OC_3H_7$ | $-C_3H_6OC_3H_7$ |
| A-32 | 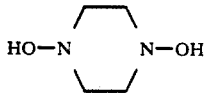 | |

These compounds are used usually in the form of free amines, hydrochlorides. sulfates, p-toluenesulfonates. oxalates, phosphates, acetates or the like.

The concentration of those compounds having Formula [I] of this invention in a color developer solution is normally from 0.2 g/liter to 50 g/liter, preferably from 0.5 g/liter to 30 g/liter, and more preferably from 1 g/liter to 15 g/liter.

From the rapid processing ability and dyeing points of view, the sulfite concentration in the color developer solution to be used in this invention is preferably not more than $4\times10^{-3}$ mole per liter of the color developer solution, and more preferably $2\times10^{-4}$ mole to zero mole. By keeping the sulfite concentration of the color developer solution low to such an extent, the developer solution's activity, even when a photographic material is processed therein, remains stable, so that no adverse effect such as significant density drop of the resulting dye's activity will arise.

The sulfite for use in this invention is sodium sulfite, potassium sulfite, sodium hydrogensulfite, potassium hydrogensulfite, or the like.

The developing agent suitably usable in this invention is a water-soluble group-having p-phenylenediamine.

The water-soluble group-having p-phenylenediamine-type compound is one whose amino group or benzene nucleus has thereon at least one water-soluble group. Particularly useful examples of the water-soluble group include:

$-(CH_2)_n-CH_2OH$, $-(CH_2)_m-NHSO_2-(CH_2)_n-CH_3$, $-(CH_2)_m-O-(CH_2)_n-CH_3$, $-(CH_2CH_2O)_nC_mH_{2m+1}$ (wherein m and n each is an integer of from zero up to 4), $-COOH$, $-SO_3H$, and the like.

In this invention, the following color developing agents are suitably usable from the fog-restraining-in-rapid-processing point of view.

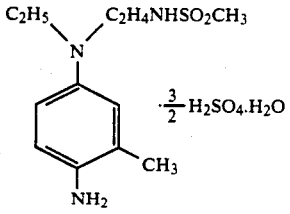
(D-1)
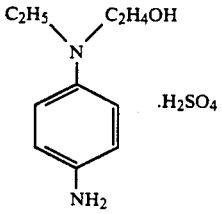
(D-2)
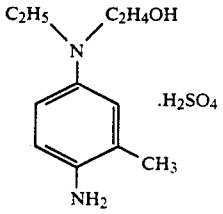
(D-3)
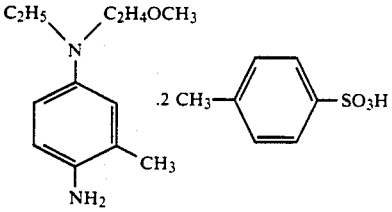
(D-4)
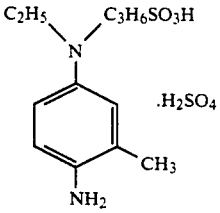
(D-5)
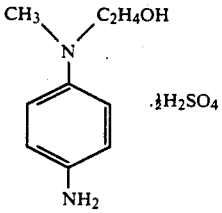
(D-6)
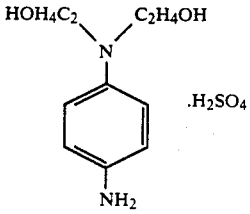
(D-7)
-continued
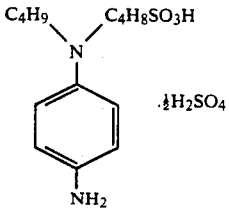
(D-8)
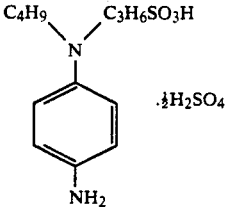
(D-9)
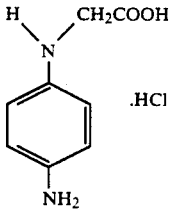
(D-10)
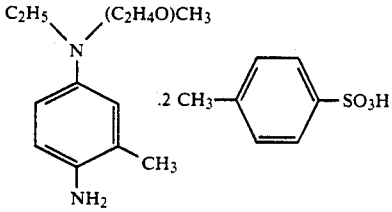
(D-11)
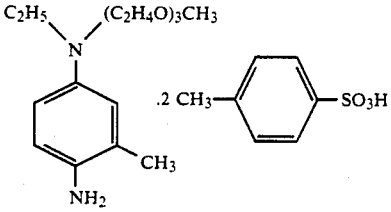
(D-12)
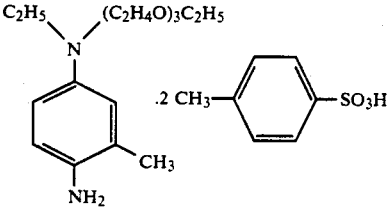
(D-13)
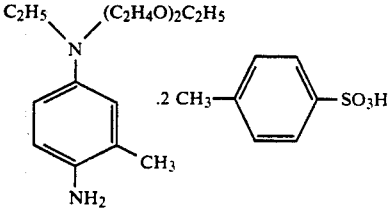
(D-14)

-continued

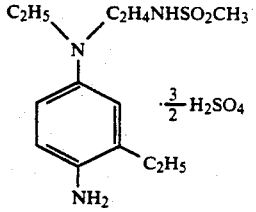

(D-15)

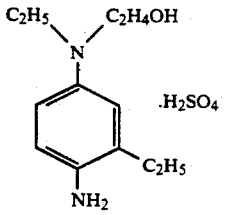

(D-16)

Of the above color developing agents, the compounds Nos. D-1), (D-2), (D-3), (D-4), (D-6), (D-7) and (D-15) can be suitably used in this invention. Above all, the most preferred one is No. (D-1).

The above color developing agents are used usually in the form of hydrochlorides, sulfates, p-toluenesulfonates, or the like.

The color developing agent, from the rapid processing point of view, is used in an amount of not less than $1.5\times10^{-2}$ moles per liter of a color developer solution, preferably in the amount range of from $2.0\times10^{-2}$ to $1.0\times10^{-1}$ mole, and more preferably from 2.5 moles to $7.0\times10^{-2}$ moles.

The color developer solution may further contain the following components:

As alkali agents, for example, sodium hydroxide, potassium hydroxide, silicates, sodium metaborate, potassium metaborate, trisodium phosphate, tripotassium phosphate, borax, and the like, may be used. These agents may be used in combination within limits not to cause any precipitation and to retain pH stabilization effects. Further, from necessity in preparation or for the purpose of raising ionic strength, various salts such as disodium hydrogenphosphate, dipotassium hydrogenphosphate, sodium hydrogencarbonate, potassium hydrogencarbonate, borates, and the like, may be used.

Also, if necessary, inorganic and organic antifoggants may be added.

Further, it is desirable that the following development accelerator be used in the color developer solution of this invention. Examples of the development accelerator include those various pyridinium compounds and other cationic compounds as disclosed in U.S. Pat. Nos. 2,648,604 and 3,671,247 and Japanese Patent Examined Publication No. 9503/1969; cationic dyes such as phenosafranine, neutral salts such as thalium nitrate; those polyethylene glycols and their derivatives as those disclosed in U.S. Pat. Nos. 2,533,990, 2,531,832, 2,950,970 and 2,577,127, and Japanese Patent O.P.I Publication No. 9504/1969; nonionic compounds such as polythioethers, etc.; those organic solvents, organic amines, ethanolamine, ethylenediamine, diethanolamine, triethanolamine, etc., as disclosed in Japanese Patent Examined Publication 9509/1969; the phenethyl alcohol, acetylene glycol, methyl-ethyl ketone, cyclohexanone, thioethers, pyridine, ammonia, hydrazine, amines, and the like, as described in U.S. Pat. No. 2,304,925.

The use of benzyl alcohol is undesirable in this invention. And the use of those poor-solubility organic solvents as represented by the above-mentioned phenethyl alcohol is desirable to be avoided in efficiently accomplishing the foregoing objects of the present invention. The use of it over a long period in the color developer solution tends to generate tar particularly in the running processing with a replenishing system, and such the generation of tar, when staining the under-liquid transport rollers or attaching onto the photographic material being processed, may even cause a serious problem of impairing the value of the processed image as a commodity.

Such poor-solubility solvent is so difficult to dissolve in water that a stirrer must be used when preparing a color developer solution. Use of such solvent is thus not only troublesome but, even when such a stirrer is used, its development of acceleration effect is limited because of poor solubility.

Furthermore, the poor-solubility solvent creates problems of high environmental pollution load such as biochemical oxygen demand (B.O.D.) and cannot be discarded to sewers or waterways. Its waste liquid disposal requires enormous labors and costs, so that the use of not only benzyl alcohol but also other poor-solubility organic solvents are desirable to be reduced to the utmost or to be abolished.

Further, the color developer solution according to this invention may, if necessary, use ethylene glycol, methyl cellosolve, methanol, acetone, dimethylformamide, $\beta$-cyclodextrin, and other compounds as disclosed in Japanese Examined publication Nos. 33378/1972 and 9509/1969 as organic solvents for use in raising the solubility of developing agents.

In addition, an auxiliary developing agent may be used along with the developing agent. As the auxiliary developing agent, for example, N-methyl-p-aminophenol sulfate, phenidone, N,N'-diethyl-p-aminophnol hydrochloride, N,N,N',N'-tetramethyl-p-phenylenediamine hydrochloride, etc., are known. The added amount of such compounds is normally preferably from 0.01 g to 1.0 g/liter.

The color developer solution may also use various other additives such as antistain agents, antisludge agents, interlayer effect accelerators and the like.

Also, addition of the following chelating agent to the color developer solution of this invention is desirable in view of the objects of this invention. Examples of the chelating agent include diethylenetriaminepentaacetic acid, ethylenediaminetetraacetic acid, nitrilotriacetic acid, ethylenediaminetetramethylenephosphonic acid, and 1-hydroxyethylidene-1,1-diphosphonic acid.

The above-mentioned components of the color developer solution may be in order added to a specified amount of water with stirring thereby to be prepared. In this instance, those components less-soluble in water may be mixed with an organic solvent mentioned above such as triethanolamine, and then added to the color developer solution. In general, a plurality of those components capable of being present together are in advance mixed to be prepared in the form of a concentrate aqueous solution or in the solid state to be stored as a stock solution or stock chemicals in a small container, and, when necessary, this is added to water with stirring for preparation of a color developer solution.

In the present invention, the above color developer solution may be used at an arbitrary pH, but from the standpoint of rapid processing, the pH is preferably from 9.5 to 13.0 and more preferably from 9.8 to 12.0.

The processing period of time in the color developing process of this invention is preferably within 35 seconds in respect of preventing the dye-staining of the underliquid rollers and restraining the fogging in the unexposed area of the photographic material being processed, more preferably in the range of from 3 to 30 seconds, more preferably in the range of from 5 to 25 seconds, and most preferably in the range of from 7 to 20 seconds.

In this invention, a photographic material, after being processed in the color developer solution, is then, without any extra process, directly processed in a processing solution having a bleaching power. The 'processing solution having a bleaching power' herein means a bleaching or bleach-fix solution. The solution having a bleaching power will now be explained.

The bleaching agent applicable to the bleaching solution or bleach-fix solution for use in this invention is an oxidation agent which is capable of transforming metallic silver into a silver compound. Those suitably usable as the bleaching agent are metallic complex salts of organic acids formed by coordination of ions of metals such as iron, cobalt, copper, etc. to organic acids such as polycarboxylic acids, aminopolycarboxylic acids or oxalic acid, citric acid, etc. The most suitable organic acids for use in forming such metallic complex salts of organic acids are aminopolycarboxylic acids. These aminopolycarboxylic acids may form alkali metallic salts, ammonium salts or water-soluble amine salts.

Particular examples of such organic acids are:

(B-1) Ethylenediaminetetraacetic acid,
(B-2) Diethylenetriaminepentaacetic acid,
(B-3) Ethylenediamine-N-(β-oxyethyl)-N,N',N'-triacetic acid, (B-4) 1,3-propylenediaminetetraacetic acid,
(B-5) Nitrilotriacetic acid,
(B-6) Cyclohexanediaminetetraacetic acid,
(B-7) Iminodiacetic acid,
(B-8) 1,2-propylenediaminetetraacetic acid,
(B-9) Ethyl-ether-diaminetetraacetic acid,
(B-10) Glycol-ether-diaminetetraacetic acid,
(B-11) Ethylenediaminetetrapropionic acid,
(B-12) Ammonium ethylenediaminetetraacetate,
(B-13) Disodium ethylenediaminetetraacetate,
(B-14) Trimethyl-ammonium ethylenediaminetetraacetate,
(B-15) Sodium ethylenediaminetetraacetate,
(B-16) Ammonium diethylenetriaminepentaacetate,
(B-17) Sodium ethylenediamine-N-(β-oxyethyl)-N,N',N'-triacetate,
(B-18) Sodium propylenediaminetetraacetate,
(B-19) Sodium nitriloacetate,
(B-20) Sodium cyclohexanediaminetetraacetate.

Of these bleaching agents, Compounds (B-2), (B-4), (B-6), (B-10) and (B-16) are particularly suitable in respect of rapid processing and antifogging characteristics. Above all. Compounds (B-2) and (B-16) are most suitable.

Any of these bleaching agents may be used in an amount of from 5 to 450 g/liter, and more preferably from 20 to 250 g/liter.

The bleach-fix solution contains a silver halide fixing agent in addition to the aforementioned bleaching agent.

Typical examples of the silver halide fixing agent to be contained in the bleach-fix solution are those compounds capable of forming water-soluble complex salts by reacting with a silver halide, as used in ordinary fixation, which include thiosulfates such as, for example, potassium thiosulfate, sodium thiosulfate, ammonium thiosulfate, etc.; thiocyanates such as potassium thiocyanate, sodium thiocyanate, ammonium thiocyanate, etc.; thiourea, thioether, and the like. Any of these fixing agents may be used in an amount of from 5 g/liter up to a soluble extent, but is used in an amount of generally from 50 to 350 g/liter.

Also, a bleach-fix solution of a composition in combination of iron (III) ethylenediaminetetraacetate with a large amount of a halogenated compound such as ammonium bromide may be used. As the halogenated compound, hydrochloric acid, hydrobromic acid, lithium bromide, sodium bromide, potassium bromide, sodium iodide, potassium iodide, ammonium iodide, or the like, may also be used in addition to the foregoing ammonium bromide.

The bleach-fix solution may contain various pH buffers such as boric acid, borax, sodium hydroxide, potassium hydroxide, sodium carbonate, potassium carbonate, sodium hydrogencarbonate, potassium hydrogencarbonate, acetic acid, sodium acetate, ammonium hydroxide, etc, which may be used alone or in combination. Further, it may also contain various brightening agents, defoaming agents or surface active agents. Furthermore, it may also arbitrarily contain preservatives such as hydroxylamine, hydrazine, hydrogensulfite adducts of aldehyde compounds such as formaldehyde-hydrogensulfite adduct, etc.; organic chelating agents such as aminopolycarboxylic acids; stabilizers such as nitroalcohol, nitrates, etc; and organic solvents such as methanol, dimethylsulfoamide. dimethylsulfoxide, and the like.

To the bleaching solution and the bleach-fix solution which are applicable to this invention may be added a known bleaching accelerating agent.

The bleach-fix solution is used at a pH of generally from 4.0 to 9.5 in view of the preservability and bleaching ability, preferably at a pH of from 4.5 to 8.5, most preferably at a pH of from 5.0 to 8.0.

The bleaching solution is used at a pH of generally from 1.0 to 7.0 from the viewpoint of rapid processing, and preferably at a pH of from 2.5 to 5.5

The processing in these processes may be made at a temperature of not more than 80° C., and preferably not more than 55° C., with care to restrain the solution from evaporating.

The processing period of time in these processing solutions having bleaching power (bleaching solution and bleach-fix solution) is preferably within 40 seconds for the objects of this invention, more preferably from 3 to 35 seconds, particularly preferably from 5 to 30 seconds, and most preferably from 7 to 25 seconds.

The bleached or bleach-fixed photographic material is then processed in the stabilization process, whereby the useless components remaining inside the photographic material are washed out or made harmless. The simplest stabilizer is water. Necessary compounds are arbitrarily added to water to thereby prepare a stabilizer solution.

Subsequently, the preferred embodiment of the stabilization process applicable to this invention will be explained.

Useful compounds for the stabilizing solution include those chelating agents whose chelating stability constant to iron ions is not less than 8, and these are suitably usable for preventing the unexposed area of a photographic material from being stained and for accomplishing the objects of the present invention.

The 'chelating stability constant' herein means the constant which is generally known by L. G. Sillen and A. E. Martell, 'Stability Constants of Metal-Ion Complexes', The Chemical Society. London (1964); S. Chaberek and A. E. Martell, 'Organic Sequestering Agents', Wiley (1959); and the like.

Examples of the chelating agent having a chelating stability constant to iron ions of not less than 8, which is suitably usable in the stabilizer solution, include organic carboxylic acid chelating agents, organic phosphoric acid chelating agents, inorganic phosphoric acid chelating agents, polyhydroxy compounds, and the like. The above iron ions means ferric ions ($Fe^{3+}$).

Examples of the chelating agent whose chelating stability constant to ferric ions is not less than 8 include the following compounds, but are not limited thereto: ethylenediaminediorthohydroxyphenylacetic acid, diaminopropanetetraacetic acid, nitrilotriacetic acid, hydroxyethylenediaminetriacetic acid, dihydroxyethylglycine, ethylenediaminediacetic acid, ethylenediaminedipropionic acid, iminodiacetic acid, diethylenetriaminepentaacetic acid, hydroxyethyliminodiacetic acid, diaminopropanoltetraacetic acid, transcyclohexanediaminetetraacetic acid, glycolether-diaminetetraacetic acid, ethylenediaminetetrakismethylenephosphonic acid, nitrilotrimethylenephosphonic acid, 1-hydroxyethylidene-1,1-diphosphonic acid, 1,1-diphosphonoethane-2-carboxylic acid, 2-phosphonobutane-1,2,4-tricarboxylic acid, 1-hydroxy-1-phosphonopropane-1,2,3-tricarboxylic acid, catechol-3,5-diphosphonic acid, sodium pyrophosphate, sodium tetrapyrophosphate and sodium hexametaphosphate. Particularly suitable ones among these compounds are the diethylenetriaminepentaacetic acid, nitrilotriacetic acid, nitrilotrimethylenephosphonic acid and I-hydroxyethylidene-1,1-diphosphonic acid. Above all, the 1-hydroxyethylidene-1,1-diphosphonic acid is most useful.

The useful amount of any of the above chelating agents is preferably from 0.01 to 50 g per liter of the stabilizer solution, more preferably from 0.05 to 20 g/liter.

Particularly useful compounds to be further added to the stabilizer solution include ammonium compounds, which are provided by ammonium salts of various inorganic compounds. Examples of such compounds include ammonium hydroxide, ammonium bromide, ammonium carbonate, ammonium chloride, ammonium acetate, and the like.

Also, a stabilizer solution of which the calcium and magnesium ions content is reduced to less than 10 ppm by ion-exchange-resin treatment may also be used.

The pH of the stabilizer solution is within the range of from 5.5 to 10.0. As the pH adjusting agent to be contained in the stabilizer solution, those generally known alkali agents or acid agents may be used.

Addition of the above compound may be carried out by various methods which include adding the compound in the form of a concentrate liquid to the stabilizer bath; adding the compound together with other additives to the stabilizer solution which is to be supplied to the stabilizer bath and this is regarded as a supply liquid to a stabilizer replenisher solution; and the like. Any of these adding methods may be used.

The number of the baths for use in the stabilizing process applicable to this invention is preferably from 1 to 3 baths, and most preferably a single bath.

The processing temperature in the stabilization process is preferably from 15° C. to 60° C., and more preferably from 20° C. to 45° C. The processing period of time in the same process is should be as short as possible in order to accomplish effectively the objects of this invention—preferably from 3 seconds to 40 seconds, and most preferably from 5 seconds to 40 seconds. In the case of the stabilization process using a plurality of baths, it is desirable to apply a shorter processing time to the early baths and a longer processing time to rear baths. It is particularly desirable to apply 20% to 50% longer time than the fore bath to one bath then to another toward the rear bath.

The method of supplying a stabilizer replenisher in the stabilizing process applicable to this invention, in the case of a multi-bath counter-current system, should be carried out in the manner of supplying the replenisher liquid to the rear bath, from which the supplied liquid is then overflown toward the first bath.

The stabilizer replenishing amount in the stabilizing process of this invention, from the standpoint of rapid processing and preservability of the resulting dye image, is preferably from 0.1 to 50 times, and particularly preferably from 0.5 to 30 times the carry-in amount of the liquid by the photographic material from the early bath (bleach-fix solution or bleaching solution).

For an automatic processor of the compact type, the stabilizer bath may be of the batch-disposable type requiring no replenishment of the stabilizer solution.

The total processing period of time of the overall process including the color developing process, bleach-fix process and stabilizing process and the like (excluding the drying process) of the present invention is preferably within 90 seconds from the viewpoint of restraining the fogging in the unexposed area of the photographic material, more preferably from 6 seconds to 75 seconds, particularly preferably from 6 seconds to 60 seconds, and most preferably from 15 seconds to 50 seconds.

Subsequently, the photographic material to be effectively processed in accordance with this invention will be explained.

Silver halide grains to be suitably used in the photographic light-sensitive material applicable to this invention are those silver halide grains of which the silver chloride content is at least 80 mole %, preferably not less than 90 mole %, more preferably not less than 95 mole %, and most preferably not less than 99 mole %.

The silver halide emulsion containing the above suitable silver halide grains may also have other silver halide compositions comprising silver bromide and/or silver iodide in addition to the above-mentioned silver chloride. In this instance, the silver bromide content is not more than 20 mole %, preferably not more than 10 mole %, more preferably not more than 5 mole %, and most preferably not more than 1 mole %. If silver iodide is present, its content is not more than 1 mole %, and preferably not more than 0.5 mole %. Such silver halide grains whose silver chloride content is not less than 80 mole % may be applied to at least one silver halide emulsion layer, and more preferably should be applied to overall silver halide emulsion layers.

These silver halide emulsion layers may be chemically and optically sensitized.

The silver halide emulsion layer to be used in this invention contains a color coupler which reacts with the oxidation product of a color developing agent to form a nondiffusible dye. The color coupler, in a nondiffusible condition, is contained in a light-sensitive layer or layers adjacent thereto.

A red-sensitive layer may contain, e.g., a cyan dye-forming nondiffusible color coupler; generally, a phenol-type or α-naphthol-type coupler. A green-sensitive layer may contain, e.g., at lease one magenta dye-forming nondiffusible color coupler; generally, a pyrazolone-type or pyrazolotriazole-type coupler. A blue-sensitive layer may contain, e.g., at least one yellow dye-forming nondiffusible color coupler; generally, an open-chain ketomethylene group-containing coupler.

In the present invention, two-equivalent-type couplers are preferred.

In this invention, from the viewpoint of the objects of this invention, it is desirable to use the following couplers: those magenta couplers having Formula [M-1] as described in p.26 of Japanese Patent O.P.I Publication No. 106655/1988 (exemplified magenta couplers are Compounds No.1 through No.77 disclosed in pp.29 to 34 of the same publication); those cyan couplers having Formula [C-I] or [C-II] described in p.34 of the same publication (exemplified cyan couplers are Compounds (C'-1) through (C'-82) and (C''-1) through (C''-36); and those high-coupling-speed yellow couplers as described in p.20 of the same publication (exemplified yellow couplers are Compounds (Y'-1) through (Y'-39).

The following are examples of those magenta couplers capable of giving particularly satisfactory results:

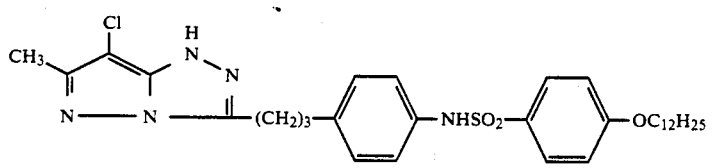

M-1

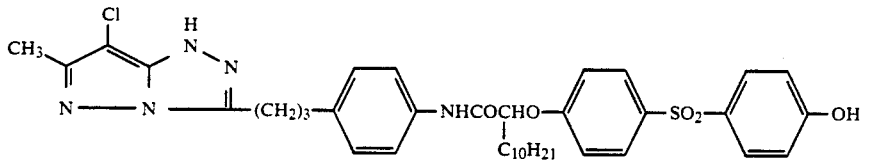

M-2

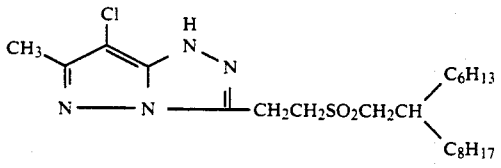

M-3

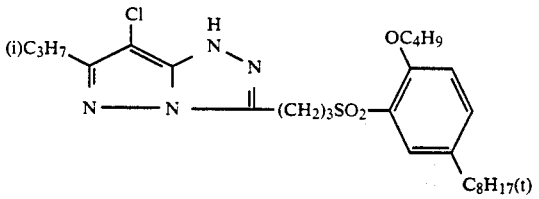

M-4

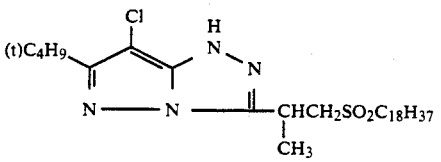

M-5

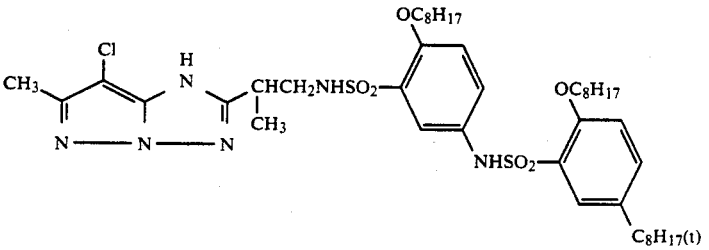

M-6

-continued

M-7

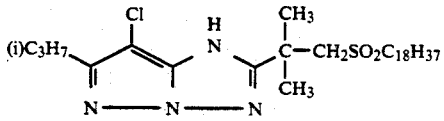

Combined use of nitrogen-containing heterocyclic mercapto compounds in the photographic light-sensitive material enables not only effective accomplishment of the objects of this invention but also significant reduction of the adverse effect upon the photographic characteristics by the color developer solution's mixing into the bleach-fix solution.

Examples of the nitrogen-containing heterocyclic mercapto compound include Compounds (I'-1) through (I'-87) disclosed in pp.42 to 45 of Japanese Patent O.P.I. Publication No. 106655/1988.

The light-sensitive silver halide emulsion may use those antifoggants and stabilizers which are commonly used. Azaindenes are particularly suitable stabilizers. Above all, tetra-and penta-azaindenes are preferred, and particularly, those substituted by a hydroxyl group or amino group are preferred. Such compounds are found in, e.g., Birr, 'Z. Wiss. Photo' 47, 1952, p.2–58, and Research Disclosure No.17643. Sec. IV.

As the support for the photographic light-sensitive material, an ordinary support may be used, on which photographic layers are provided.

The aforementioned component materials of the light-sensitive material may be incorporated into the photographic layers in accordance with commonly known methods, for which reference can be made to, e.g., U.S. Pat. Nos. 2,322,027, 2,533,514, 3,689,271, 3,764,336 and 3,765,897.

EXAMPLES

The present invention will now be illustrated further in detail by the following examples:

Example 1

On a polyethylene-coated paper support were coated the following layers in order from the support side, whereby a light-sensitive material sample was prepared. The polyethylene-coated paper support used herein is a quality paper weighing 165 g/m$^2$ on one side of which is formed by the extrusion coating method a 0.035 mm-thick coat layer of a mixture of 200 parts by weight of a polyethylene having an average molecular weight of 100,000 in a density of 0.95, 20 parts by weight of another polyethylene having an average molecular weight of 2,000 in a density of 0.80, and 6.7% by weight anatase-type titanium oxide, and on the other side of which is formed a 0.040 mm-thick layer comprised of polyethylene alone. The coating of the following layers in the described order was performed after subjecting the polyethylene-coated layer surface of the paper support to a corona-discharge pretreatment.

Layer 1: A blue-sensitive silver halide emulsion comprising a chlorobromide emulsion (containing 0.5 mole % silver bromide) containing gelatin in an amount of 340 g per mole of silver halide, sensitized by using $2.4\times10^{-4}$ moles per mole of silver halide of Sensitizing Dye III having the following formula (dissolved in isopropyl alcohol as a solvent) and also containing 200 mg/m$^2$ of 2,5-di-t-butyl-hydroquinone dispersed into dibutyl phthalate and $2.1\times10^{-1}$ moles per mole of silver halide of Yellow Coupler [Y] having the following formula. The layer is coated so that the coating weight of silver is 300 mg/m$^2$.

Layer 2: A gelatin layer containing 310 mg/m$^2$ of di-t-octylhydroquinone dissolved into dibutyl phthalate and dispersed and also containing 200 mg/m$^2$ of a mixture of 2-(2'-hydroxy-3',5'-di-t-butylphenyl)benzotriazole, 2-(2'-hydroxy-5'-t-butylphenyl)benzotriazole, 2-(2'-hydroxy-3'-t-butyl-5'-methylphenyl)-5-chlorobenzotriazole and 2-(2'-hydroxy-3',5'-di-t-butylphenyl)-5-chlorobenzotriazole (1:1:1:1) as ultraviolet absorbing agents. The layer is coated so that the coating weight of gelatin is 2,000 mg/m$^2$.

Layer 3: A green-sensitive silver halide emulsion layer comprising a chlorobromide emulsion (containing 0.3 mole % silver bromide) containing gelatin in an amount of 460 g per mole of silver halide, sensitized by using $2.5\times10^{-4}$ moles per mole of silver halide of Sensitizing Dye I having the following formula, and also containing 2,5-di-t-butyl-hydroquinone dissolved into a mixture of dibutyl phthalate and tricresyl phosphate (2:1) and $1.5\times10^{-1}$ moles per mole of silver halide of Magenta Coupler M having the following formula. The layer is coated so that the coating weight of silver is 200 mg/m$^2$. In addition, 2,2,4-trimethyl-6-lauryloxy-7-t-octyl-chroman as an antioxidation agent is added in an amount of 0.30 mole per mole of the coupler to the above emulsion.

Layer 4: A gelatin layer containing 25 mg/m$^2$ of di-t-octylhydroquinone dissolved into dioctyl phthalate and dispersed and also containing 500 mng/m$^2$ of a mixture of 2-(2'-hydroxy-3',5'-di-t-butylphenyl)benzotriazole, 2-(2'-hydroxy-5'-t-butylphenyl)benzotriazole, 2-(2'-hydroxy-3'-t-butyl-5'-methylphenyl)-5'-chlorobenzotriazole and 2-(2'-hydroxy-3',5'-di-t-butylphenyl)-5-chlorobenzotriazole (2:1.5:1.5:2) as ultraviolet absorbing agents. The layer is coated so that the coating weight of gelatin is 2,000 mg/m$^2$.

Layer 5: A red-sensitive silver halide emulsion layer comprising a chlorobromide emulsion (containing 0.3 mole % silver bromide) containing gelatin in an amount of 500 g per mole of silver halide, sensitized by using $2.5\times10^{-4}$ moles per mole of silver halide of Sensitizing Dye II having the following formula, and also containing 160 mg/m$^2$ of 2,5-di-t-butyl-hydroquinone dissolved into dibutyl phthalate and dispersed and $3.8\times10^{-1}$ moles per mole of silver halide of Cyan Coupler [C] having the following formula. The layer is coated so that the coating weight of silver is 250 mg/m$^2$.

Layer 6: A gelatin layer coated so that the coating weight of gelatin is 900 mg/m$^2$.

The silver halide emulsion that is used in the light-sensitive emulsion layers (Layers 1, 3 and 5) was prepared in accordance with the method described in Japanese Patent Examined Publication No 7772/1971, chemically sensitized by using sodium thiosulfate pentahydrated, and into this were incorporated 2.5 g per mole of silver halide of 4-hydroxy-6-methyl-1,3,3a,7-tetrazaindene as a stabilizer, 12 mg per mole of gelatin of bis-(vinylsulfonylmethyl) ether as a hardening agent and saponin as a coating aid.

Sensitizing Dye [I]

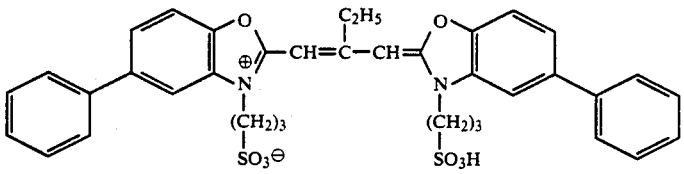

Sensitizing Dye [II]

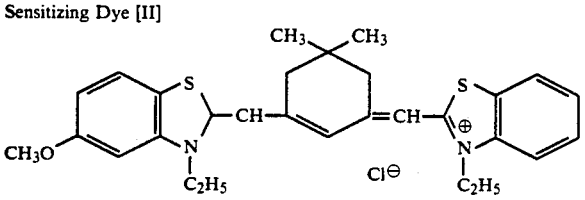

Sensitizing Dye [III]

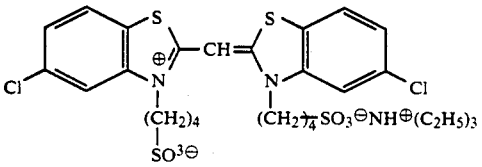

Coupler [Y]

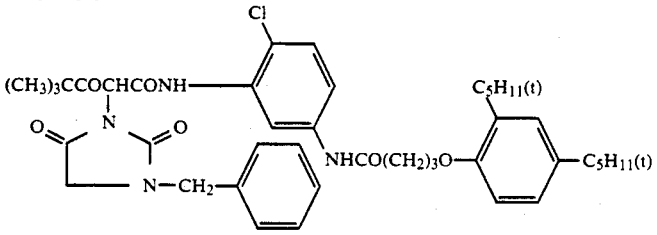

Coupler [M]

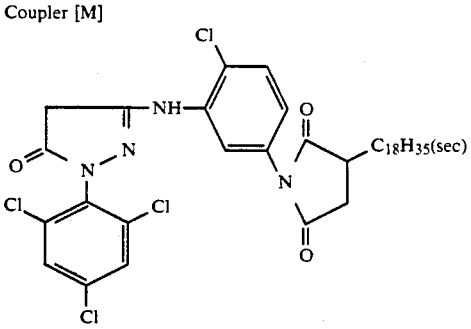

Coupler [C]

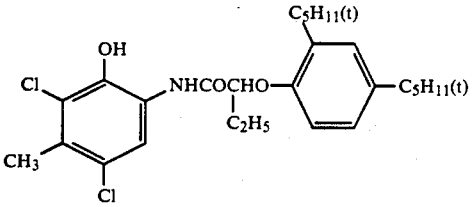

The color photographic paper sample that was prepared in the above manner, after being exposed, was processed in the following steps by using the following processing solutions:

| Processing steps (single bath for each step) | Temperature | Time |
|---|---|---|
| (1) Color developing | 35° C. to 60° C. | (see Table 1) |
| (2) Bleach-fix | 38° C. | 15 seconds |
| (3) Stabilizing | 38° C. | 10 seconds |
| (4) Drying | 60° C. to 80° C. | 30 seconds |

Color Developer Tank Solution:

-continued

| | |
|---|---|
| Benzyl alcohol | 0.5 g |
| Diethylene glycol | 10.0 g |
| Potassium bromide | 0.01 g |
| Potassium chloride | 2.3 g |
| Potassium sulfite (aqueous 50% solution) | 0.5 ml |
| Color developing agent, 3-methyl-4-amino-N-ethyl-N-(β-methanesulfonamidoethyl)-aniline sulfate | 5.0 g |
| Diethyl-hydroxylamine (85%) | 5.0 g |
| Triethanolamine | 10.0 g |
| Potassium carbonate | 30.0 g |
| Sodium ethylenediaminetetraacetate | 2.0 g |
| Brightening agent (Kaycol PK-Conc, produced by Nippon Soda Co., Ltd.) | 2.0 g |
| Water to make 1 liter. Adjust the pH to 10.15 by using potassium hydroxide or sulfuric acid. | |
| Color Developer Replenisher Tank Solution: | |
| Benzyl alcohol | 0.5 g |
| Diethylene glycol | 10.0 g |
| Potassium chloride | 3.0 g |
| Potassium sulfite (aqueous 50% solution) | 1.5 ml |
| Color developing agent, 3-methyl-4-amino-N-ethyl-N-(β-methanesulfonamidoethyl)-aniline sulfate | 8.0 g |
| Diethyl-hydroxylamine (85%) | 7.0 g |
| Triethanolamine | 10.0 g |
| Potassium carbonate | 30.0 g |
| Sodium ethylenediaminetetraacetate | 2.0 g |
| Brightening agent (Kaycol PK-Conc, produced by Nippon Soda Co.. Ltd.) | 2.5 g |
| Water to make 1 liter. Adjust the pH to 10.40 by using potassium hydroxide or sulfuric acid. | |
| Bleach-Fix Tank Solution and Relenisher: | |
| Ferric-ammonium diethylenetriaminepenta-acetate | 65.0 g |
| Diethylenetriaminepentaacetic acid | 3.0 g |
| Ammonium thiosulfate (aqueous 70% solution) | 100.0 ml |
| 5-Amino-1,3,4-thiadiazole-2-thiol | 0.5 g |
| Ammonium sulfate (aqueous 40% solution) | 27.5 ml |
| Adjust the pH to 6.50 by using aqueous ammonia or glacial acetic acid, and add water to make 1 liter. | |
| Stabilizer Tank Solution and Replenisher: | |
| Ortho-phenyl-phenol | 1.0 g |
| 5-Chloro-2-methyl-4-isothiazolin-3-one | 0.02 g |
| 2-Methyl-4-isothiazolin-3-one | 0.02 g |
| Ethylene glycol | 1.0 g |
| Tinopal SFP (produced by Ciba Geigy) | 2.0 g |
| 1-Hydroxyethylidene-1.1-diphosphonic acid (aqueous 60% solution) | 3.0 g |
| $BiCl_3$ (aqueous 45% solution) | 0.65 g |
| $MgSO_4.7H_2O$ | 0.2 g |
| PVP (polyvinyl pyrrolidone) | 1.0 g |
| Aqueous ammonia (aqueous 25% ammonium hydroxide solution) | 2.5 g |
| Trisodium nitrilotriacetate | 1.5 g |
| Water to make 1 liter. Adjust the pH to 7.5 by using aqueous ammonia or sulfuric acid. | |

The above-prepared color photographic paper sample and the above processing solutions were used to carry out running processing tests.

The running processing took place in an automatic processor filled with the above-mentioned color developer tank solution, bleach-fix tank solution and stabilizer tank solution, being replenished at intervals of three minutes with the foregoing color developer replenisher solution, bleach-fix replenisher solution and stabilizer replenisher solution, respectively, supplied through metering pumps thereto during the processing run of the color photographic paper.

The replenishing amount to the color developer tank was 180 ml per square meter of the color photographic paper, the replenishing amount to the bleach-fix tank was 220 ml per square meter, and that to the stabilizer tank was 250 ml per square meter.

The running processing was continued until the total volume of the replenished color developer liquid becomes five times the capacity of the color developer tank.

The processing running test took place with the air-time ratio in the color developing process of the automatic processor being changed as shown in Table 1.

Further, the color developing took place at a temperature of 60° C. in processing for 3 to 5 seconds, at 50° C. for 7 to 15 seconds, at 40° C. for 20 to 35 seconds, and at 35° C. for 40 to 60 seconds so that the development activity is kept almost constant.

The processed color photographic paper sample after the running processing was measured with respect to its unexposed area's magenta color fog density by using a photoelectric densitometer, and besides, the cyan dye stain condition was observed.

The results are as collectively shown in Table 1.

TABLE 1

| Test No. | Color developing Time (sec) | Color developing Air-time ratio (%) | Magenta fog density | Cyan dye stain condition | Remarks |
|---|---|---|---|---|---|
| 1-1 | 60 | 30 | 0.05 | B-C | Invention |
| 1-2 | 50 | 30 | 0.05 | B-C | Invention |
| 1-3 | 40 | 30 | 0.05 | B-C | Invention |
| 1-4 | 35 | 30 | 0.04 | B | Invention |
| 1-5 | 30 | 30 | 0.04 | A | Invention |
| 1-6 | 25 | 30 | 0.03 | A | Invention |
| 1-7 | 20 | 30 | 0.02 | A | Invention |
| 1-8 | 15 | 30 | 0.02 | A | Invention |
| 1-9 | 10 | 30 | 0.02 | A | Invention |
| 1-10 | 7 | 30 | 0.02 | A | Invention |
| 1-11 | 5 | 30 | 0.03 | A | Invention |
| 1-12 | 3 | 30 | 0.03 | B | Invention |
| 1-13 | 15 | 5 | 0.05 | C C | Comparative |
| 1-14 | 15 | 10 | 0.05 | C | Comparative |
| 1-15 | 15 | 15 | 0.03 | B | Invention |
| 1-16 | 15 | 20 | 0.03 | A | Invention |
| 1-17 | 15 | 25 | 0.02 | A | Invention |
| 1-18 | 15 | 30 | 0.02 | A | Invention |
| 1-19 | 15 | 40 | 0.02 | A | Invention |
| 1-20 | 15 | 50 | 0.03 | A | Invention |
| 1-21 | 15 | 65 | 0.04 | A | Invention |
| 1-22 | 15 | 70 | 0.07 | A | Comparative |
| 1-23 | 15 | 80 | 0.08 | A | Comparataive |

In Table 1, 'A' implies that no cyan dye stain is found in the white background, 'B' implies that slight cyan dye stain is found, and 'C' implies that the appearance of the cyan dye stain is so conspicuous as to lose value of commodity. In addition, the larger the number of 'C' marks, the larger the degree of its appearance.

From Table 1, it is apparent that when the air-time ratio is from 15 to 65%, the magenta dye fog density is low, and the cyan dye stain also is relatively satisfactory. Above all, when the color developing time is within 35 seconds, these effects are satisfactory; the color developing time should be within the range of preferably from 3 seconds to 30 seconds, particularly from 5 seconds to 25 seconds, and most preferably from 7 seconds to 20 seconds.

Example 2

Tests were carried out in the same manner as in Example 1 except that 0.12 mg/m$^2$ each of the exemplified heterocyclic compounds (I'-24), (I'-41), (I'-60), (I'-66), (I'-79) and (I'-84) described in Japanese Patent O.P.I. Publication No. 106655/1988 was added to each of the emulsion layers of the color photographic paper sample that was used in Example 1. As a result, the magenta dye fog densities in the unexposed area were found 20 to 30% more improved.

Example 3

Tests were made in the same manner as in Example 1 except that the Magenta Coupler [M] in the color photographic paper that was used in Example 1 was replaced by the pyrazolotriazole-type magenta couplers M-1, M-2, M-3, M-4, M-5, M-6 and M-7. As a result, althought the cyan dye stain was almost the same as in Example 1, the magenta fog density in the unexposed area was excellent i.e. as low as 0.01.

Example 4

Tests took place in the same manner as in Example 1 except that the diethylhydroxylamine in the color developer solution that was used in Example 1 was replaced by equimolar amounts of Exemplified Compounds A-13, A-18, A-21 and A-7 as hydroxylamine derivatives (compounds represented by Formula [I]). Consequently, nearly the same results as in Example 1 were obtained. However, when the diethylhydroxylamine was replaced by an equimolar amount of hydroxylamine sulfate, the maximum density of the yellow was reduced by 0.65, and besides, the cyan dye stain also was worsened.

Example 5

When tests were performed in the same manner as in Example 1 except that the cyan coupler [C] in the color photographic paper that was used in Example 1 was replaced by the cyan couplers (C'-2), (C'-27), (C'-32), (C'-33), (C'-34), (C'-36), (C'-37), (C'-38), (C'-39), (C'-53), (C''-2), (C''-8) and (C''-9) disclosed in pp.34 through 42 of Japanese Patent O.P.I. Publication No. 106655/1988, the cyan dye stain was found 20 to 40% more improved.

Example 6

On a polyethylene-coated paper support were formed the following layers in order from the support side, whereby a light-sensitive material sample was prepared.

The polyethylene-coated paper support used herein is a quality paper weighing 165 g/m$^2$ on one side of which is formed by the extrusion coating method a 0.035 mm-thick coat layer of a mixture of 200 parts by weight of a polyethylene having an average molecular weight of 100,000 in a density of 0.95, 20 parts by weight of a polyethylene having an average molecular weight of 2,000 in a density of 0.80, and 6.7 by weight anatase-type titanium oxide, and on the other side of which is formed a 0.040 mm-thick layer comprised of polyethylene alone. The coating of the following layers in the described order was performed after subjecting the polyethylene-coated layer surface of the paper support to a corona-discharge pretreatment.

Layer 1: A blue-sensitive silver halide emulsion layer comprising a chlorobromide emulsion (containing 0.4 mole % silver bromide) containing gelatin in an amount of 340 g per mole of silver halide, sensitized by using $2.4\times10^{-4}$ moles per mole of silver halide of Sensitizing Dye III having the foregoing formula (dissolved in isopropyl alcohol as a solvent) and also containing 200 mg/m$^2$ of 2,5-di-t-butyl-hydroquinone dispersed into dibutyl phthalate and $2.1\times10^{-1}$ moles per mole of silver halide of Yellow Coupler [Y] having the foregoing formula. The layer is coated so that the coating weight of silver is 310 mg/m$^2$.

Layer 2: A gelatin layer containing 310 mg/m$^2$ of di-t-octylhydroquinone dissolved into dibutyl phthalate and dispersed and also containing 200 mg/m$^2$ of a mixture of 2-(2'-hydroxy-3',5'-di-t-butylphenyl)benzotriazole, 2-(2'-hydroxy-5'-t-butylphenyl)benzotriazole, 2-(2'-hydroxy-3'-t-butyl-5'-methylphenyl)-5-chlorobenzotriazole and 2-(2'-hydroxy-3',5'-di-t-butylphenyl)-5-chlorobenzotriazole (1:1:1:1) as ultraviolet absorbing agents. The layer is coated so that the coating weight of gelatin is 1900 mg/m$^2$.

Layer 3: A green-sensitive silver halide emulsion layer comprising a chlorobromide emulsion (containing 0.4 mole % silver bromide) containing gelatin in an amount of 460 g per mole of silver halide, sensitized by using $2.5\times10^{-4}$ moles per mole of silver halide of Sensitizing Dye [I] having the foregoing formula, and also containing 2,5-di-t-butylhydroquinone dissolved into a mixture of dibutyl phthalate and tricresyl phosphate (2:1) and $1.5\times10^{-1}$ moles per mole of silver halide of Magenta Coupler [M] having the foregoing formula. The layer is coated so that the coating weight of silver is 200 mg/m$^2$. In addition, 2,2,4-trimethyl-6-lauryloxy-7-octyl-chroman as an antioxidation agent is added in an amount of 0.29 mole per mole of the coupler to the above emulsion.

Layer 4: A gelatin layer containing 25 mg/m$^2$ of di-t-octylhydroquinone dissolved into dioctyl phthalate and dispersed and also containing 500 mg/m$^2$ of a mixture of 2-(2'-hydroxy-3',5'-di-t-butylphenyl)benzotriazole, 2-(2'-hydroxy-5'-5-butylphenyl)benzotriazole, 2-(2'-hydroxy-3'-t-butyl-5'-methylphenyl)-5'-chlorobenzotriazole and 2-(2'-hydroxy-3',5'-di-t-butylphenyl)-5-chlorobenzotriazole (2:1.5:1.5:2) as ultraviolet absorbing agents. The layer is coated so that the coating weight of gelatin is 2,000 mg/m$^2$.

Layer 5: A red-sensitive silver halide emulsion layer comprising a chlorobromide emulsion (containing 0.4 mole % silver bromide) containing gelatin in an amount of 500 g per mole of silver halide, sensitized by using $2.5\times10^{-4}$ moles per mole of silver halide of Sensitizing Dye [II] having the foregoing formula, and also containing 160 mg/m$^2$ of 2,5-di-t-butylhydroquinone dissolved into dibutyl phthalate and dispersed and $3.8\times10^{-1}$ moles per mole of silver halide of Cyan Coupler [C] having the foregoing formula. The layer is coated so that the coating weight of silver is 240 mg/m$^2$.

Layer 6: A gelatin layer coated so that the coating weight of gelatin is 900 mg/m$^2$.

The silver halide emulsion that is used in the light-sensitive emulsion layers (Layers 1, 3 and 5) was prepared in accordance with the method described in Japanese Patent Examined Publication No. 7772/1971, chemically sensitized by using sodium thiosulfate pentahydrated, and into this were incorporated 2.5 g per mole of silver halide of 4-hydroxy-6-methyl-1,3,3a,7-tetrazaindene as a stabilizer, 11 mg per mole of gelatin of bis-(vinylsulfonylmethyl) ether as a hardening agent and saponin as a coating aid.

The sensitizing dyes and the couplers which were used in the above layers are the same ones as those described in Example 1.

The thus prepared color photographic paper sample, after being imagewise exposed, was processed in the following steps by using the following processing solutions:

| Processing steps (single bath for each step) | Temperature | Time |
|---|---|---|

-continued

| | | |
|---|---|---|
| (1) Color developing | 38° C. | 15 seconds |
| (2) Bleach-fix | 35° C.-60° C. | See Table 2 |
| (3) Stabilizing | 38° C. | 10 seconds |
| (4) Drying | 60° C.-80° C. | 30 seconds |

| | |
|---|---|
| Color Developer Tank Solution: | |
| Diethylene glycol | 10.0 g |
| Potassium bromide | 0.01 g |
| Potassium chloride | 2.3 g |
| Potassium sulfite (aqueous 50% solution) | 0.5 ml |
| Color developing agent, 3-methyl-4-amino-N-ethyl-N-(β-methanesulfonamidoethyl)-aniline sulfate | 6.8 g |
| Diethylhydroxylamine (85%) | 5.0 g |
| Triethanolamine | 10.0 g |
| Potassium carbonate | 30.0 g |
| Sodium ethylenediaminetetraacetate | 2.0 g |
| Brightening agent (Kaycol PK-Conc, produced by Nippon Soda Co., Ltd.) | 2.0 g |
| Water to make 1 liter. Adjust the pH to 10.15 by using potassium hydroxide or sulfuric acid. | |
| Color Developer Replenisher Solution: | |
| Diethylene glycol | 10.0 g |
| Potassium chloride | 3.0 g |
| Potassium sulfite (aqueous 50% solution) | 1.5 ml |
| Color developing agent, 3-methyl-4-amino-N-ethyl-N-(β-methanesulfonamidoethyl)-aniline sulfate | 8.4 g |
| Diethylhydroxylamine (85%) | 7.0 g |
| Triethanolamine | 10.0 g |
| Potassium carbonate | 30.0 g |
| Sodium ethylenediaminetetraacetate | 2.0 g |
| Brightening agent (Kaycol PK-Conc. produced by Nippon Soda Co., Ltd.) | 2.5 g |
| Water to make 1 liter. Adjust the pH to 10.40 by using potassium hydroxide or sulfuric acid. | |
| Bleach-fix Tank Solution and Replenisher: | |
| Ferrous-ammonium diethylenetriamine-pentaacetate | 65.0 g |
| Diethylenetriaminepentaacetic acid | 3.0 g |
| Ammonium thiosulfate (aqueous 70% solution) | 100.0 ml |
| 5-Amino-1,3,4-thiadiazole-2-thiol | 0.5 g |
| Ammonium sulfite (aqueous 40% solution) | 27.5 ml |
| Adjust the pH tO 6.50 and add water to make 1 liter | |
| Stabilizer Tank Solution and Replenisher: | |
| Orthophenylphenol | 1.0 g |
| 5-Chloro-2-methyl-4-isothiazolin-3-one | 0.02 g |
| 2-Methyl-4-isothiazolin-3-one | 0.02 g |
| Ethylene glycol | 1.0 g |
| Tinopal SFP (produced by Ciba Geigy) | 2.0 g |
| 1-Hydroxyethylidene-1,1-diphosphonic acid (aqueous 60% solution) | 3.0 g |
| $BiCl_3$ (aqueous 45% solution) | 0.65 g |
| $MgSO_4.7H_2O$ | 0.2 g |
| PVP (polyvinyl pyrrolidone) | 1.0 g |
| Aqueous ammonia (aqueous 25% ammonium hydroxide solution) | 2.5 g |
| Trisodium nitrilotriacetate | 1.5 g |
| Water to make 1 liter. Adjust the pH to 7.5 by using aqueous ammonia or sulfuric acid. | |

The above-prepared color photographic paper sample and the above processing solutions were used to make running processing tests.

The running processing took place in an automatic processor filled with the above-mentioned color developer tank solution, bleach-fix tank solution and stabilizer tank solution, being replenished at intervals of three minutes with the foregoing color developer replenisher solution, bleach-fix replenisher solution and stabilizer replenisher solution, respectively, supplied through metering pumps thereto during the processing run of the color photographic paper.

The replenishing amount to the color developer tank was 180 ml per square meter of the color photographic paper, the replenishing amount to the bleach-fix tank was 180 ml per square meter, and that to the stabilizer tank was 250 ml per square meter.

The running processing was continued until the total volume of the replenished bleach-fix liquid becomes five times the capacity of the bleach-fix tank.

The running processing test took place with the air-time ratio in the bleach-fix process of the automatic processor being changed as given in Table 2.

Further, the processing in the bleach-fix process was made at 60° C. in processing for 3 to 5 seconds, at 50° C. for 7 to 15 seconds, at 40° C. for 20 to 35 seconds and at 35° C. for 40 to 60 seconds so that the processing activity is kept almost constant.

The processed color photographic paper sample after the running processing was measured with respect to its unexposed area's magenta color stain densities by using a photoelectric densitometer, and in addition, the amount of the residual silver in the maximum density area was measured by the fluorescent X-ray spectrographic analysis method.

The results are collectively shown in Table 2.

TABLE 2

| | Bleach-fix process | | | | |
|---|---|---|---|---|---|
| Test No. | Processing time (sec) | Air-time ratio (%) | Magenta fog density | Residual silver (mg/100 cm²) | Remarks |
| 2-1 | 60 | 30 | 0.05 | 0 | Invention |
| 2-2 | 50 | 30 | 0.05 | 0 | Invention |
| 2-3 | 40 | 30 | 0.04 | 0 | Invention |
| 2-4 | 35 | 30 | 0.03 | 0 | Invention |
| 2-5 | 30 | 30 | 0.03 | 0 | Invention |
| 2-6 | 25 | 30 | 0.02 | 0 | Invention |
| 2-7 | 20 | 30 | 0.02 | 0 | Invention |
| 2-8 | 15 | 30 | 0.02 | 0 | Invention |
| 2-9 | 10 | 30 | 0.02 | 0 | Invention |
| 2-10 | 7 | 30 | 0.02 | 0.2 | Invention |
| 2-11 | 5 | 30 | 0.02 | 0.4 | Invention |
| 2-12 | 3 | 30 | 0.02 | 0.8 | Invention |
| 2-13 | 15 | 5 | 0.07 | 0.4 | Comparative |
| 2-14 | 15 | 10 | 0.06 | 0.3 | Comparative |
| 2-15 | 15 | 15 | 0.03 | 0.1 | Invention |
| 2-16 | 15 | 20 | 0.02 | 0.1 | Invention |
| 2-17 | 15 | 25 | 0.02 | 0 | Invention |
| 2-18 | 15 | 30 | 0.02 | 0 | Invention |
| 2-19 | 15 | 40 | 0.02 | 0 | Invention |
| 2-20 | 15 | 50 | 0.03 | 0.1 | Invention |
| 2-21 | 15 | 60 | 0.04 | 0.3 | Invention |
| 2-22 | 15 | 70 | 0.07 | 1.0 | Comparative |
| 2-23 | 15 | 80 | 0.09 | 1.2 | Comparative |

From Table 2 it is apparent that when the air-time ratio in the bleach-fix process is within the range of 15 to 65%, the results are so satisfactory that the magenta fog density is low and also the amount of the residual silver is slight. Further, these effects are more satisfactory when the processing time in the bleach-fix process is within 40 seconds, still more satisfactory when in the range of from 3 to 35 seconds, particularly satisfactory when in the range of from 5 to 30 seconds, and most satisfactory when in the range of from 7 to 25 seconds.

Example 7

Similar tests took place with use of the pyrazolotriazole-type magenta couplers M-1, M-2, M-3, M-4, M-5, M-6 and M-7 in place of the Magenta Coupler [M] in the color photographic paper that was used in the tests of Example 6. Consequently, the results obtained were so satisfactory that, although, the amount of the residual silver was nearly the same as in Example 1, the magenta color fog in the unexposed area was further reduced by 20 to 30%.

Example 8

Tests took place in the same manner as in Example 1 except that the diethylhydroxylamine in the color developer solution that was used in the test (No.2-7) of the tests of Example 6 was replaced by equimolar amounts of hydroxylamine derivatives' Exemplified Compounds A-13, A-18, A-21 and A-7 (compounds represented by Formula [I]). Consequently, almost the same results as in Example 1 were obtained. However, when the diethylhydroxylamine was replaced by an equimolar amount of hydroxylamine sulfate, the maximum density of the yellow was reduced from 2.98 to 2.27; i.e., reduced by 0.71, and besides, the residual amount of silver was unsatisfactorily high.

Example 9

Similar tests were carried out with use of the cyan couplers (C'-2), (C'-27), (C-32), (C'-33), (C'-34), (C'-36), (C'-37), (C'-38), (C'-39), (C'-53), (C''-2), (C''-8) and (C''-9) that are described in pp.34 to 42 of Japanese Patent O.P.I. Publication No. 106655/1988 in place of the cyan coupler [C] in the color photographic paper that was used in the tests of Example 6. As a result, the residual amount of silver was found 10 to 30% more improved.

Example 10

Tests were made in the same manner as in the tests No. 1-13 and No.1-18 of Example 1 except that the silver chloride content of the silver chlorobromide emulsion of the emulsion layers that were used in Example 1 was varied as shown in the following Table 3. Each of the obtained color photographic paper samples, after being processed, was measured with respect to its unexposed area's magenta color fog density and its maximum density area's yellow density by using a photoelectric densitometer, and further, the cyan dye stain condition was observed.

The results are as collectively shown in Table 2.

TABLE 3

| Test No. | Air-time ratio (%) | AgCl content (mol %) | Magenta fog density | Cyan dye stain condition | Yellow density | Remarks |
|---|---|---|---|---|---|---|
| 3-1 | 5 | 60 | 0.02 | B-A | 1.50 | Com. |
| 3-2 | 5 | 70 | 0.02 | B | 1.83 | " |
| 3-3 | 5 | 80 | 0.02 | C | 2.13 | " |
| 3-4 | 5 | 90 | 0.03 | C | 2.33 | " |
| 3-5 | 5 | 95 | 0.04 | C | 2.44 | " |
| 3-6 | 5 | 99 | 0.04 | C C | 2.49 | " |
| 3-7 | 5 | 99.5 | 0.04 | C C | 2.55 | " |
| 3-8 | 30 | 60 | 0.00 | A | 1.52 | Inv. |
| 3-9 | 30 | 70 | 0.01 | A | 1.81 | " |
| 3-10 | 30 | 80 | 0.01 | A | 2.12 | " |
| 3-11 | 30 | 90 | 0.01 | A | 2.30 | " |
| 3-12 | 30 | 95 | 0.01 | A | 2.41 | " |
| 3-13 | 30 | 99 | 0.02 | A | 2.47 | " |
| 3-14 | 30 | 99.5 | 0.02 | LA | 2.52 | " |

In the above table, the 'A', 'B' and 'C' are as defined in the foregoing Table 1.

As is apparent from Table 3, where the air-time ratio is within the range of this invention, both magenta fog density and cyan dye stain condition are satisfactory. Above all, the samples whose silver chloride content is not less than 80 mole % show adequate dye densities and have characteristics adaptable to rapid processing. Particularly, when the silver chloride content is preferably not less than 90 mole %, more preferably not less than 95 mole % and most preferably not less than 99 mole %, more adequate dye densities can be obtained.

Example 11

The color photographic paper sample that was prepared in Example 1 was used to make running processing tests in the manner that the sample, after being exposed, was processed in the following processing solutions according to the following procedure:

| Processing steps (single bath for each step) | Temperature | Time |
|---|---|---|
| (1) Color developing | 38° C. | 15 seconds |
| (2) Bleaching | 35° C. | 15 seconds |
| (3) Fixing | 35° C. | 10 seconds |
| (4) Stabilizing | 35° C. | 20 seconds |
| (5) Drying | 60° C. to 80° C. | 30 seconds |

The color developer and stabilizer solutions for use in this example are the same as those in Example 1.

| | |
|---|---|
| Bleacher Tank Solution and Replenisher: | |
| Ferric-ammonium 1,3-propylenediaminetetra-acetate | 45 g |
| Ferrous-ammonium ethylenediaminetetraacetate | 40 g |
| Ammonium bromide | 160 g |
| Ammonium acetate | 35 g |
| Imidazole | 2 g |
| Aqueous ammonia (25% solution) | 8 ml |
| Water to make 1 liter. Adjust the pH to 4.0 by using aqueous ammonia or acetic acid. | |
| Fixer Tank Solution and Replenisher: | |
| Diethylenetriaminepentaacetic acid | 3.0 g |
| Ammonium thiosulfate (aqueous 70% solution) | 100.0 ml |
| Ammonium sulfite (aqueous 40% solution) | 27.5 ml |
| Adjust the pH to 6.50 by using aqueous ammonia or acetic acid, and add water to make 1 liter. | |

The air-time ratios in both the color developing process and the bleaching process in the above processing steps were varied as shown in the following Table 4, and the resulting magenta color fog densities in the unexposed area of the color photographic paper sample were measured.

The results are as collectively given in Table 4.

TABLE 4

| Test No. | Air-time ratio (%) Color dev. process | Air-time ratio (%) bleaching process | Unexposed area's magenta color fog density | Remarks |
|---|---|---|---|---|
| 4-1 | 10 | 30 | 0.05 | Comparative |
| 4-2 | 15 | 30 | 0.04 | Invention |
| 4-3 | 20 | 30 | 0.04 | " |
| 4-4 | 25 | 30 | 0.03 | " |
| 4-5 | 30 | 30 | 0.03 | " |
| 4-6 | 40 | 30 | 0.03 | " |
| 4-7 | 50 | 30 | 0.03 | " |
| 4-8 | 65 | 30 | 0.04 | " |
| 4-9 | 70 | 30 | 0.08 | Comparative |
| 4-10 | 80 | 30 | 0.09 | " |

As is apparent from Table 4, when the air-time ratio is within the range according to this invention, the magenta color fog density is satisfactory. Also, by comparison between the above Table 4 and the foregoing Table 1, it is understood that the processing in which the color developing process is followed by the bleach-fix process is better in the magenta fog density effect.

Example 12

The light-sensitive material sample and the processing solutions which were prepared in Example 1 were used to make running processing tests in which the air-time ratios and processing periods of time in the color developing process, bleach-fix process and stabilizing process were varied as shown in the following Table 5.

TABLE 5

| Test No. | Processing time (sec) Color dev. | Bleach-fix | Stabilize | Air-time ratio (%) Color dev. | Bleach-fix | Stabilize | Unexposed area's Magenta fog density | Remarks |
|---|---|---|---|---|---|---|---|---|
| 5-1 | 15 | 15 | 10 | 10 | 10 | 10 | 0.05 | Comparative |
| 5-2 | 15 | 15 | 10 | 30 | 10 | 10 | 0.02 | Invention |
| 5-3 | 15 | 15 | 10 | 30 | 30 | 10 | 0.01 | " |
| 5-4 | 15 | 15 | 10 | 30 | 30 | 30 | 0.01 | " |
| 5-5 | 40 | 15 | 10 | 30 | 30 | 30 | 0.02 | " |
| 5-6 | 40 | 50 | 10 | 30 | 30 | 30 | 0.03 | " |

These tests took place at temperatures of 50° C. in color developing for 15 seconds, 35° C. in color developing for 40 seconds, 50° C. in bleach-fix for 15 seconds, and 35° C. in bleach-fix for 50 seconds As is apparent from Table 5, where the air-time ratio is within the range of 15 to 65% throughout the whole processes, the effect of this invention is conspicuously exhibited. Further, regarding the processing time, when the color developing time is within 35 seconds and the bleach-fix time is within 40 seconds, the magenta stain is satisfactorily reduced.

What is claimed is:

1. A method of processing an exposed silver halide color photographic material having a silver chloride content of at least 80 mole %, comprising a step of color development, a step of bleach fixing, and a step of stabilizing, wherein an air-time ratio of 15 to 65% is utilized at the step of color development or at the step of bleach fixing.

2. A method of claim 1, wherein the air-time ratio is 20 to 50%.

3. A method of claim 1, wherein the air-time ratio is 25 to 40%.

4. A method of claim 1, wherein the step of stabilising is for a period of 3 to 50 seconds.

5. A method of claim 1, wherein the step of bleach-fixing is followed directly by the step of stabilising.

6. A method of claim 1 wherein the air-time ratio at the step of color development is 15 to 65%.

7. A method of claim 1 wherein the air-time ratio at the step of bleach fixing is 15 to 60%.

8. A method of claim 1 wherein the silver halide in the color photographic material has a silver bromide content of not more than 20 mole %.

9. A method of claim 8 wherein the silver bromide content is not more than 10 mole %.

10. A method of claim 9 wherein the silver bromide content is not more than 5 mole %.

11. A method of claim 1 wherein the silver halide in the color photographic material has a silver iodide content of not more than 1 mole %.

* * * * *